US005991956A

United States Patent [19]

Chapman

[11] Patent Number: 5,991,956

[45] Date of Patent: Nov. 30, 1999

[54] PAINT BRUSH GRIP

[76] Inventor: John Chapman, 126 Raglan Rd., North Perth, Australia, 6006

[21] Appl. No.: 09/018,929

[22] Filed: Feb. 5, 1998

[51] Int. Cl.[6] ..... A46B 17/02

[52] U.S. Cl. ..... 15/146; 15/145; 16/114 R; 16/DIG. 25

[58] Field of Search ..... 15/145, 146; 16/114 R, 16/DIG. 12, DIG. 25

[56] References Cited

U.S. PATENT DOCUMENTS

| | | | |
|---|---|---|---|
| 2,914,785 | 12/1959 | Ela | 16/DIG. 12 |
| 4,495,669 | 1/1985 | Hooper | 16/DIG. 12 |
| 4,854,625 | 8/1989 | Eubanks et al. | 15/146 |
| 4,911,575 | 3/1990 | Tidwell | 16/114 R |
| 5,499,637 | 3/1996 | Foti | 15/145 |
| 5,625,922 | 5/1997 | Morad | 16/114 R |

FOREIGN PATENT DOCUMENTS

| | | | |
|---|---|---|---|
| 2803842 | 8/1979 | Germany | 15/145 |
| 3004708 | 8/1980 | Germany | 15/145 |

*Primary Examiner*—Mark Spisich
*Assistant Examiner*—Theresa T. Snider

[57] ABSTRACT

A grip for ergonomic comfort attaches to the handle of a paint brush and has a pistol style grip, the top of which has a pair of v-shaped cradles separated by about 10 cms. These cradles extend from a rear arm and a short front arm. Between the arms, a strap arrangement captures a paintbrush by applying downward force to the brush handle mounted onto the cradles. The strap is secured to a top region of pistol grip, and it is adjustable either by a velcro fastening method or a buckle cleat.

7 Claims, 4 Drawing Sheets

20
22
13
23
18
21
17
16
24
14
15
12
11
25
19

PAINT BRUSH GRIP

TECHNICAL FIELD

This invention relates to paint brushes accessories and more specifically to a handle or grip to attach to a conventional paint brush as used by handymen and professionals at home and in industry.

Paint brushes have been used for decades or even centuries and their form has been relatively unchanged during this long period. In essence they comprise a bunch of bristles, gathered by a collar attached to a handle which is generally a smoothly contoured stem with an axis parallel to the bristles. In use, the hand of a painter clasps the handle and the brush is manipulated as desired. Whilst the arrangement may seem adequate, in fact during prolonged painting or painting with wide brushes when quite a bit of force is required to apply the paint, the brush handle becomes very uncomfortable, arm muscles become sore and even blisters can form on fingers.

The main factors contributing to this discomfort are the angle of the hand with respect to the wrist and the thinness of the handle. It has been found that a significantly more comfortable arrangement can be achieved by incorporating a pistol grip subtending at an angle to the brush handle. With such an arrangement, the wrist can be maintained in a more natural attitude and the larger surface area of the grip tends to spread the forces on the palm of the hand.

BACKGROUND ART

An attempt to make a more comfortable brush grip had been made in patent application DE 28 03 842 (Jan. 30, 1978). This patent application proposes a grip perpendicular to a brush handle, the handle being of a cylindrical variety and captured within a v-groove at the upper edge of the grip. The handle is held against the v-groove by a brace that passes over the handle and is coupled to a threaded stem. The threaded stem is engaged with a thumb nut which bears against the bottom edge of the grip, allowing the brace to be tightened or released.

The shortcomings of the above mentioned invention are numerous (which may be responsible for the invention never being commercialised). Firstly, the grip needs to be essentially perpendicular to the handle to accommodate the brace tightening mechanism. Ideally the handle needs to be angled backwards for optimum comfort. Secondly, by having a continuous v-groove, the grip will only accept cylindrical handles. Most brush handles these days are profiled with a thicker mid region. Such handles would rock within a v-groove, and could slide along it which would be unacceptable. Thirdly, the invention requires at least four components and assembly, both of which result in high manufacturing costs. Additionally, thumb screw mechanisms can be over tightened, damaging a component and also releasing and securing a paintbrush is not a quick operation as may be desirable when having to frequently separate a brush from a grip to reach the bottom of a paint tin.

SUMMARY OF THE INVENTION

This instant invention overcomes the deficiencies of the prior art and resides in a paint brush grip having a handgrip portion and a head portion, said head portion characterised by front and rear raised cradles depending from arms which extend beyond front and rear edges of the hand grip and therebetween is disposed an adjustable strap which is secured to an upper portion of the handgrip, the handgrip portion being characterised by being angled backwards, in use a brush handle is secured between the cradles and the strap.

BRIEF DESCRIPTION OF THE DRAWINGS

The invention can be better understood when reference is had by way of example to the accompanying illustrations in which.

DESCRIPTION OF THE PREFERRED EMBODIMENTS

Figure 1:
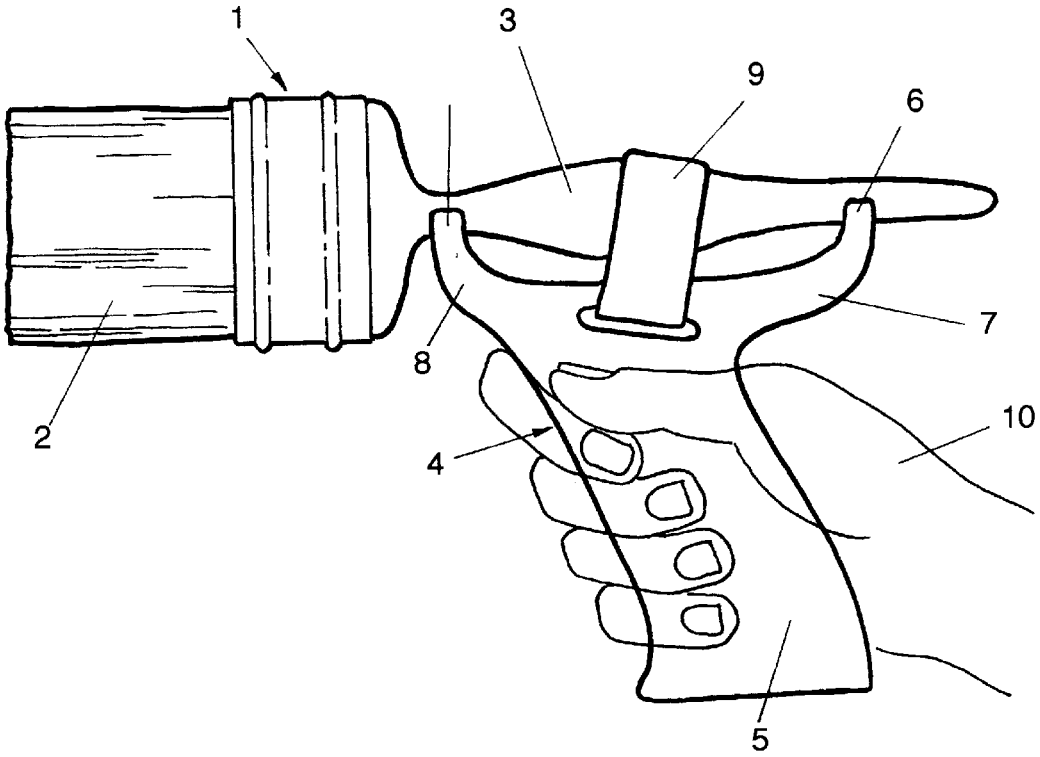
FIG. 1 shows the general features of the invention

Referring to FIG. 1, a paint brush 1 has a bristle portion 2 extending from a handle 3. The shape and size of the handle can come in many variations. A grip 4 is fashioned in the shape of a pistol grip and comprises a hand grip portion 5 and two cradle supports 6. The cradle supports are integral with rear and forward arms 7 and 8. The forward arm is short, to merely provide clearance of a brush from an operator's forefinger. A strap 9 holds the handle 3 against the cradle supports. In use an operator's hand 10 wraps around the grip 4. The cradle supports bear against the underside of the handle, one cradle being positioned in a 'neck' region of the handle. The cradles have a V- or U-shaped cross section so as to provided lateral positioning of the handle. The grip and cradle supports can be fashioned from plastic material using injection moulding techniques and can be either solid or have hollow sections.

Figure 2:
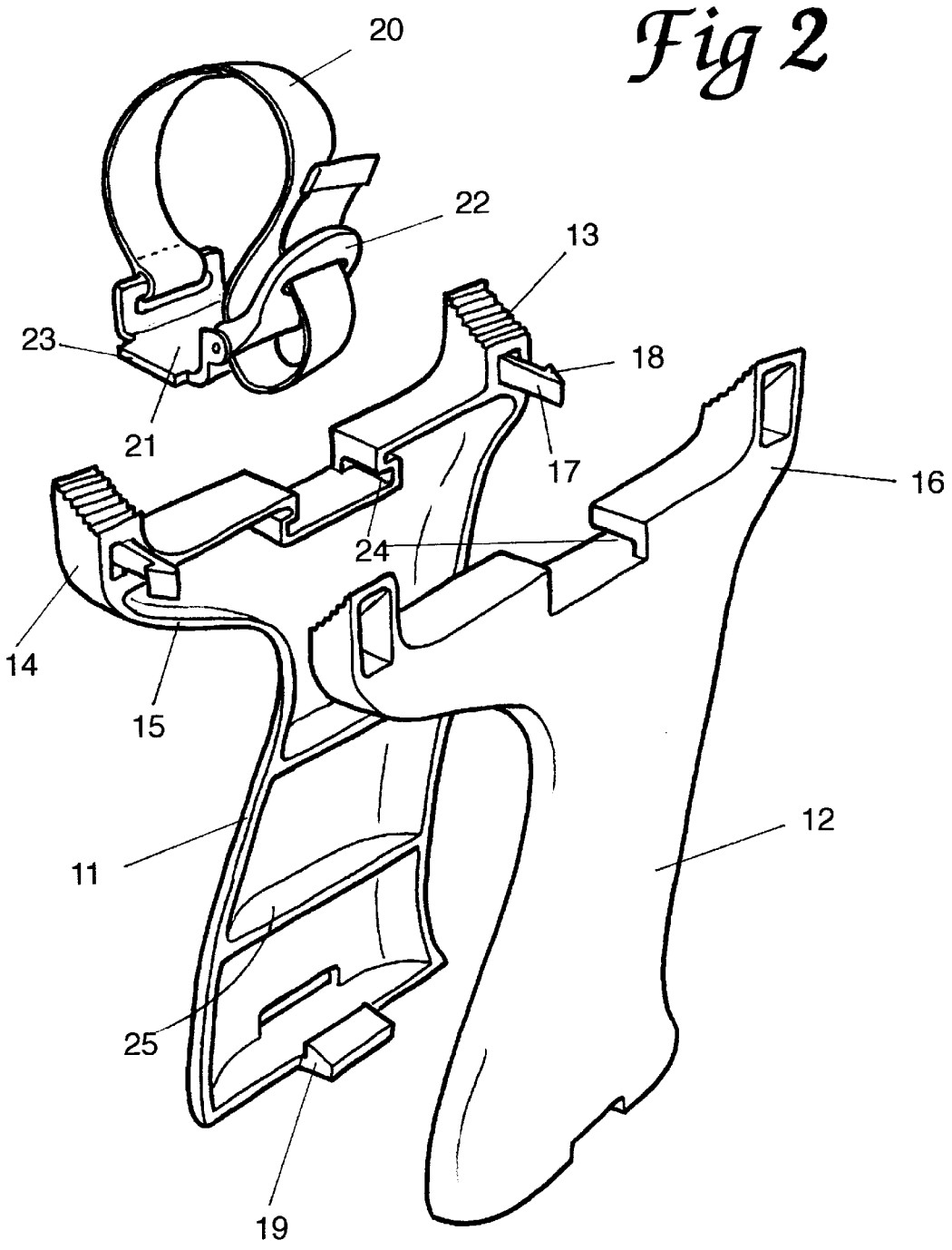
FIG. 2 shows a strap and buckle embodiment of the invention in which the grip is assembled from two moulded halves.

FIG. 2 shows one embodiment of the invention more specifically. Referring to the figure, the grip has two halves 11 and 12. Considering one of the halves, there is a front cradle 13 and rear cradle 14. The inclined surface of the cradle is serrated to reduce rotational slippage of a brush bearing against the surface. The cradles are separated by about 8 cms, achieved by having a rearward extending arm 15 and a much shorter forward extending arm 16. Immediately below each cradle there are means to couple to the other grip half. For example a prong 17 has a tooth 18 which engages with the other half when the two halves are pressed together. A similar coupling 19 can be included at the bottom edge. Alternatively the two halves maybe secured by conventional screws. Additionally, the lowest edges of both halves could be joined by a thin seam of plastic which acts as a hinge. When the two halves of the grip are joined, the cradle has a width at its widest point of about 15–20 mm. The shape of the cradle can be either V shaped or part circular.

A strap 20 is connected to a buckle base 21 which includes a cam gripping buckle 22. This mechanism is very similar to that employed to secure lights to bicycle handlebars, and so does not form part of the invention. The buckle base 21 has protruding flanges 23 on opposing sides of the base, these flanges are captured within recesses 24 on each half of the grip. In use, the strap passes over a paintbrush handle and is tightened by means of the buckle. The strap is made from substantially inelastic material such as woven nylon or other synthetic or natural material.

The grip halves 11 and 12 have ribs 15 to provide stiffness to the handle. Such ribbing is a common feature in hollow plastic injection moulded items.

Because the tightening force generated by the buckle can be quite high it will tend to force apart the two halves of the cradle. If it is found that the connector means between the two halves is insufficient, then an alternative arrangement depicted in FIG. 3 would be more suitable.

Figure 3:
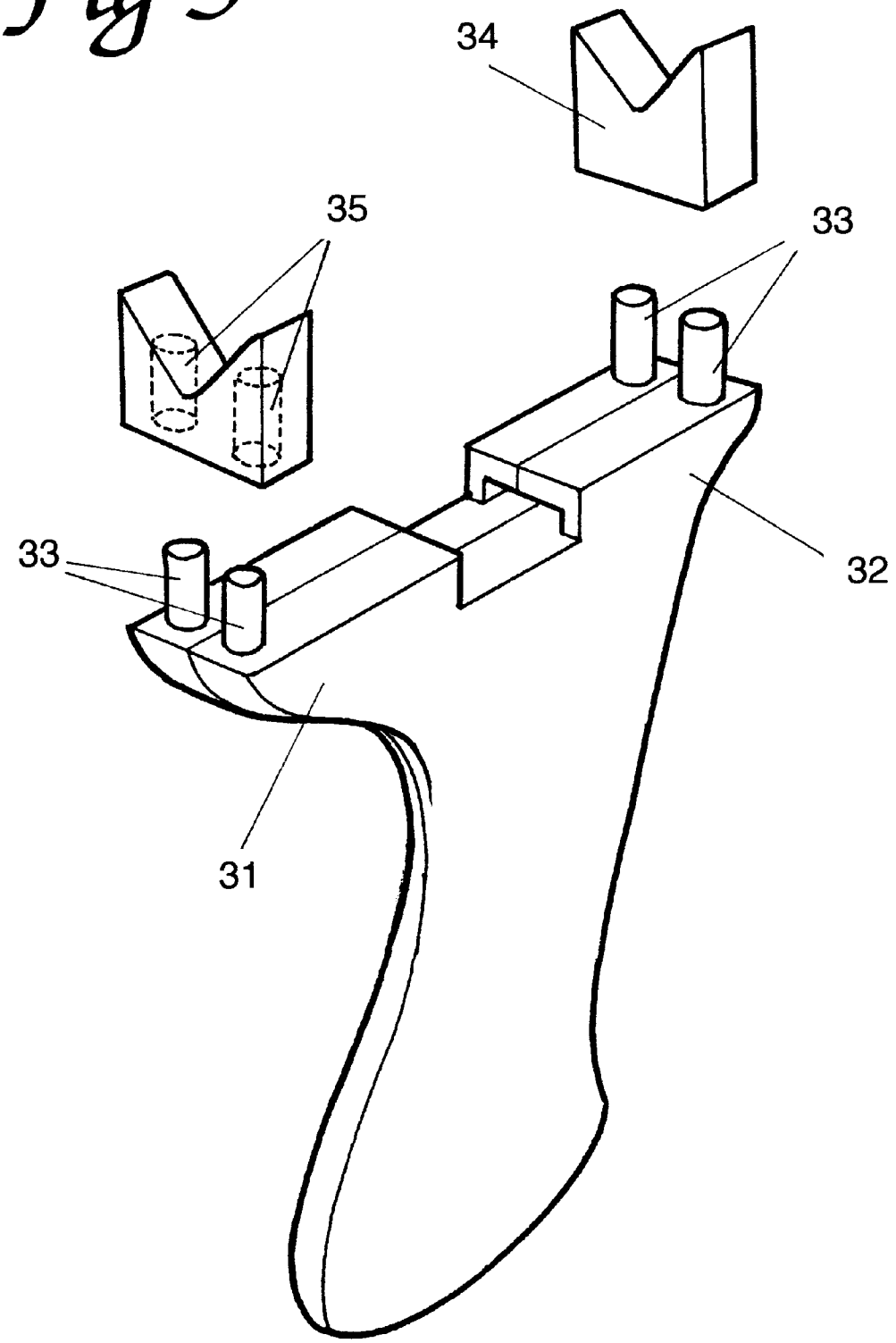
FIG. 3 shows a modification in which caps are used as a joining method for the buckle embodiment.

Referring to FIG. 3 in which the buckle bracket is not shown, the uppermost portion of the grip has rear and forward arms 31 and 32. Protruding upwards from each half of the arms are posts 33 in the position of the cradles. Cradles caps 34 having recesses 35 are pressed over the posts, and serve to hold the two halves together. Another advantage about this arrangement is that it allows for interchangeable cradles which can differ in size or shape so as to accept different sized or shaped paint handles.

The embodiments described above comprise more than one plastic component, so some assembly, although minimal, is necessary. An alternative embodiment which can be moulded from a single piece of plastic is depicted in FIG. 4.

Figure 4:
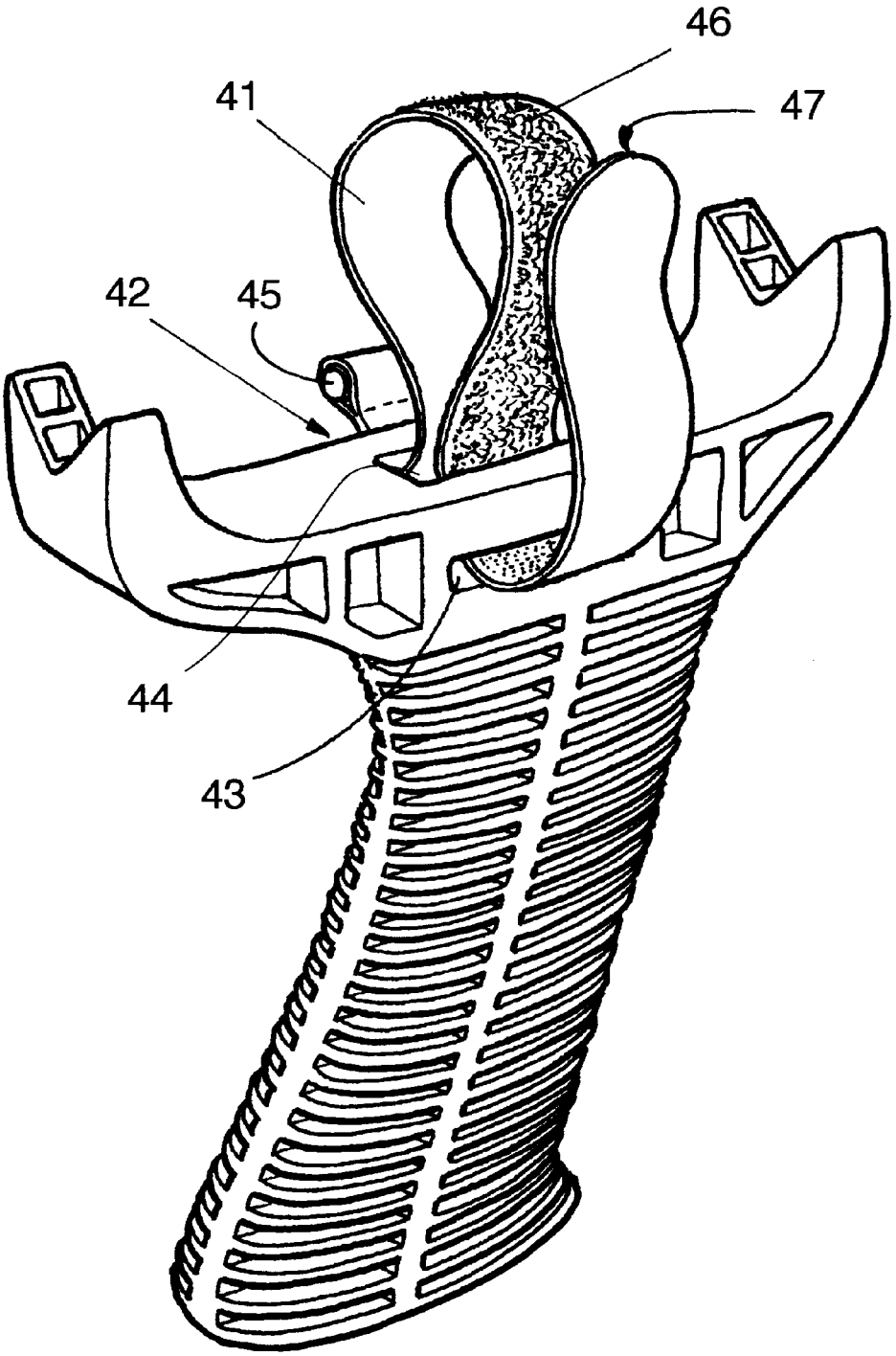
FIG. 4 shows a VELCRO™ strap embodiment of the invention, applied to a grip which can be moulded in a single unit.

Referring to FIG. 4, the item has the same principle features of handle-grip, arms and cradles as described for FIG. 2. Each of these portions are comprised of walls and hollows as shown, thereby minimising the cool down rate during manufacture and so increasing the production cycle time from a mould. The preferred strapping mechanism is different for this embodiment. A VELCRO™ strap 41 passes through slots 42 (not shown) and 43 and through a strap aperture 44. The strap is prevented from slipping through slot 42 by a rod 45 stitched into the strap. During use this rod bares against the outside of the slot 42. The VELCRO™ strap comprises loop and hook sections 46 and 47, which when brought into contact provide a semi-adhesion. During use the strap passes over a paintbrush handle and through the strap aperture. The free end of the strap which passes through slot 43 is tightened and doubled back, the hook section is pressed against the section of strap that bares against the brush handle. The upper edge of the slots could be curved so the VELCRO™ can recline to wrap around non-cyclindrical brush handles.

Someone skilled in the moulding art will appreciate that the component depicted in FIG. 3 can be fashioned from three moulds; one for each half of the grip handle and a third for the arms, cradles and strap aperture.

Reference to plastic means any suitable plastics material such as polypropylene and includes any structural mouldable material such as aluminium.

In either of the above described embodiments it may be preferable to contour the handgrip for example by scalloping finger contours in a front edge of the grip. It may also be desirable to texture the outer surface or even include many small holes to absorb moisture from the palm of the hand. For added comfort a layer of leather, suede, rubber or other suitable material can be applied over the base of the grip.

The dimensions and contours of the components will be evident to someone skilled in the art and can be gleaned from the representations. Typically the thickness of the grip would be about 2 centimeters.

It will be seen from the foregoing discussion that the invention provides for a useful improvement in the field of painting, both domestically and industrially and that it provides for an elegant solution to the problem of hand fatigue and discomfort experienced while painting. The accessory could also receive other implements such as a felt pen for use by persons suffering from arthritis or other afflictions which make holding narrow stems difficult.

The invention is not limited to the above described embodiments but extends to variations falling within the scope of the invention that might be incorporated by persons competent in the technical art.

I claim:

1. A paint brush grip comprising a handgrip portion and a head portion, said head portion characterised by front and rear raised cradles depending from arms which extend beyond front and rear upper edges of the hand grip portion and therebetween is disposed an adjustable strap which is secured to an upper portion of the handgrip portion wherein said cradles and strap are capable of capturing a brush handle therebetween, the handgrip portion being characterised by being angled backwards from the head portion.

2. A paint brush grip as in claim 1 wherein the adjustable strap is a hook and loop strap which is captured within a slot fashioned within the upper portion of the handgrip portion.

3. A paintbrush grip as in claim 1 wherein the adjustable strap is a non-extensible fabric that is secured at one end to a base and the other end is constrained within a cleat-buckle that is pivotally attached to said base, said base being secured to the upper portion of the handgrip portion.

4. A paintbrush grip as in claim 1 wherein the handgrip and head portions comprise two halves coupled together.

5. A paintbrush grip as in claim 1 wherein the cradles have a v- or u-shaped cross section.

6. A paintbrush as in claim 1 wherein the handgrip and head portions are a single component made from plastic material.

7. A paint brush grip comprising a handgrip portion and a head portion, said head portion characterised by front and rear arms which extend beyond front and rear upper edges of the hand grip portion and upper surfaces of said arms having upwardly extending protrusions onto which cradle caps can be fitted to support a paintbrush handle which is held onto the cradle caps by an adjustable strap which is secured to an upper portion of the handgrip portion.

* * * * *